United States Patent [19]

Larreategui

[11] Patent Number: 5,011,056

[45] **Date of Patent: * Apr. 30, 1991**

[54] INFLATABLE CHILD HOLDER

[76] Inventor: Fred E. Larreategui, Ed. Banco de los Andes, Av. Amazonas 477 y Roca 8 piso, of. 806, Quito, Ecuador

[ * ] Notice: The portion of the term of this patent subsequent to Apr. 10, 2007 has been disclaimed.

[21] Appl. No.: 505,621

[22] Filed: Apr. 6, 1990

Related U.S. Application Data

[63] Continuation-in-part of Ser. No. 315,976, Feb. 27, 1989, Pat. No. 4,915,277.

[51] Int. Cl.[5] ..... A61G 1/00

[52] U.S. Cl. ..... 224/159; 224/158; 224/208; 224/907; 297/DIG. 3

[58] Field of Search ..... 224/158, 159, 160, 161, 224/208, 257, 907; 297/DIG. 3

[56] References Cited

U.S. PATENT DOCUMENTS

| | | | |
|---|---|---|---|
| 4,627,659 | 12/1986 | Hall | 297/DIG. 3 X |
| 4,711,490 | 12/1987 | Brand | 297/DIG. 3 X |
| 4,915,277 | 4/1990 | Larreategui | 224/159 |

*Primary Examiner*—Ernest G. Cusick
*Attorney, Agent, or Firm*—J. Sanchelima

[57] ABSTRACT

An inflatable holder for children removably mounted on a person with saddle seat member having a downwardly extending leg member that is positioned against the person's upper thigh. Two slightly curved arm members, substantially perpendicular to the leg member, conform and embrace the waistline of the person. Several backing members are provided to strengthen the rigidity of the holder. A belt for removably securing the saddle seat member to the person's waist and a strap member attached to the back of the saddle seat member are primarily responsible for supporting the latter. An inwardly extending flange member helps to keep the holder on the waist of the user.

6 Claims, 1 Drawing Sheet

INFLATABLE CHILD HOLDER

OTHER RELATED APPLICATIONS

The present application is a continuation-in-part of allowed and pending of U.S. patent application Ser. No. 07/315,976, filed on Feb. 27, 1989, now U.S. Pat. No. 4,915,277, which is hereby incorporated by reference.

BACKGROUND OF THE INVENTION

1. Field of the Invention

The present invention relates to holders for children, and more particularly, to such inflatable holders that are intended to be removably mounted on an individual.

2. Description of the Related Art

Carrying babies and children in a person's arms could be a stressful proposition after several hours. Parents and others carrying children are constantly changing positions in order to fight their tired muscles. Many devices have been designed to alleviate this problem with a great variety of approaches. Some of these designs involve a compromise on the comfort of the child with respect to that of the person carrying him or her. The parent application lacks any claims for inflatable implementations of the present invention.

SUMMARY OF THE INVENTION

It is one of the main objects of the present invention to provide a holder for children that is ergonometrically suited for the use by an individual while at the same time providing the child with maximum comfort.

It is another object of this present invention to provide such a holder that is inflatable light and durable.

It is yet another object of this present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
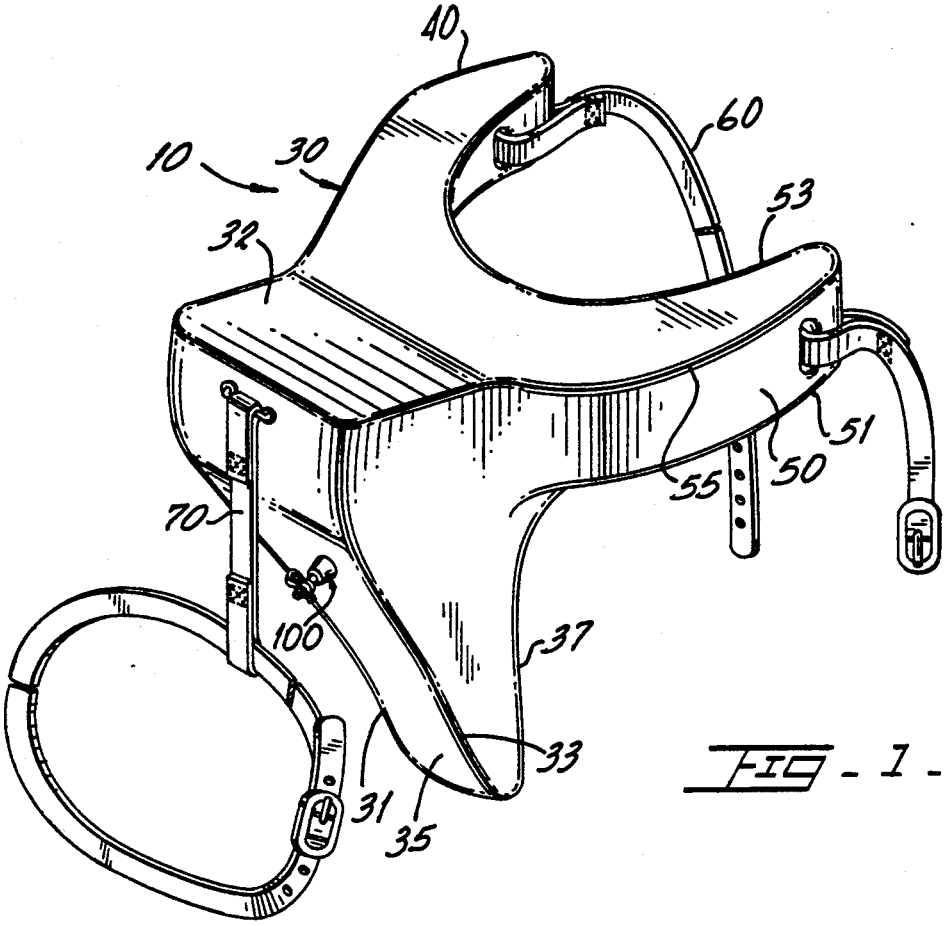
FIG. 1 is a view in perspective of one of the preferred embodiments in accordance with the present invention.
Figure 2:
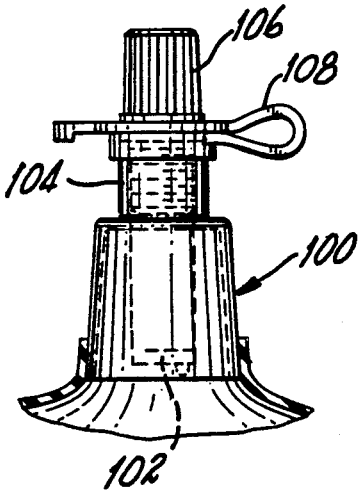
FIG. 2 is a side elevational view of one type of valve used in one of the preferred embodiments for the present invention.
Figure 3:
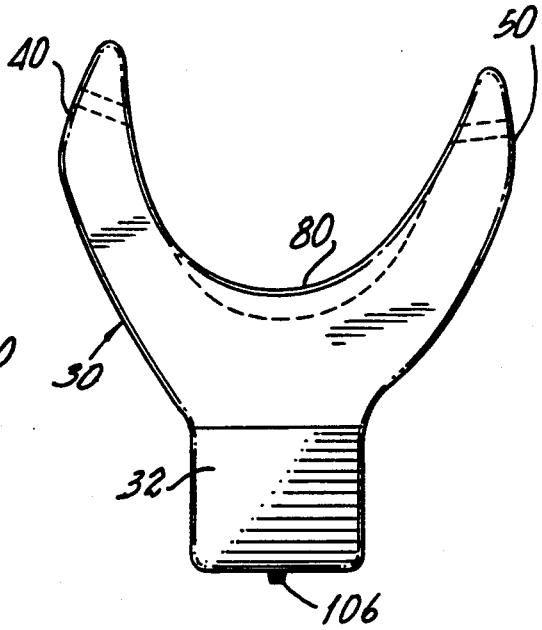
FIG. 3 is a top view of the present invention.

Referring now to FIG. 1, where the present invention is generally referred to with numeral 10, it can be observed that it basically includes a saddle seat member 30 having a downwardly extending leg 35 and two arm members 40 and 50, substantially perpendicularly disposed with respect to leg member 35. Also, member 30 includes a flat seating area 32 suitable to support seated children on it. Arm members 40 and 50 embrace the user's upper hip area. Belt member 60 is rigidly mounted to the ends of arm members 40 and 50 and provides the means for removably mounting holder 10 to the user. A strap member 70 is preferably rigidly mounted to the back portion of saddle seat member 30 and it has sufficiently large dimensions to extend around the user's shoulder and neck area opposite to the side where holder 10 is mounted.

Arm members 40 and 50 are ergonometrically designed to embrace the user's upper hip area. Arm member 40 is less curved than member 50 since member 40 is intended to conform to the user's lower back area while arm member 50 conforms to the front and lower abdominal area. Since user's anatomical dimensions vary greatly, holders 10 will have different dimensions. Preferably, saddle seat member 30 is made out of sheets of plastic material or rubber with some degree of flexibility when inflated, specially with respect to the separation of arms 40 and 50 so that the gripping effect of these arms over the user's hip area can be firmly and comfortably achieved. Saddle seat member 30 is inflated with sufficient air pressure to make arms 40 and 50, as well as leg member 35 sufficiently rigid to support the weight of a child seating on surface 32. It is also possible to make seat member 30 out of other inflatable flexible materials if the proper structural backing members are incorporated, specially along the downwardly extending leg 35. These reinforcing backing members are represented in FIG. 1 with enlarged or thicker corners 31; 33; 37; 51; 53 and 55 that enhance the rigidity of the structure.

Another feature that has been added to the present invention is an inwardly extending flange member 80 that is intended to partially rest over the user's hip bones. Again, anatomical considerations may require different dimensions of flange member 80 for women and men since the former have a more pronounced waist curvature. A material of certain flexibility is desirable so that it would comfortably conform to the anatomy of the user.

Belt member 60 can be implemented with any of a variety of conventional belts and associated buckles for releasably mounting holder 10 to the user's hip area. Strap member 70 can also be implemented with any one of conventionally existing adjustable straps for easy positioning around the user's neck and shoulder opposite to the side where the holder is mounted.

A valve assembly 100 is shown mounted on leg member 35. However, it can be mounted on any location of saddle member 30 with the only consideration that it be accessible for a user to reach it with his or her mouth to blow the air in. Valve assembly 100 is implemented in one of the preferred embodiments with valves of the type used in beach life vests, rafts balls and tubes. Typically, these valves are provided with a one way valve member 102 that opens inwardly when air is pushed in and closes when the air inside tries to escape. Mouthpiece 104 includes a cap 106 that can be either threaded or pressure fitted over mouthpiece 104. A cord or strap 108 is rigidly secured to mouthpiece 104 and to cap 106 to keep the attached to mouthpiece 104.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A holder for children removably mounted on a person, comprising:

A. saddle seat means having a downwardly extending leg member that is positioned against the person's upper thigh and having two slightly curved arm members, substantially perpendicular to said leg member, that conform and embrace the waistline of the person; and one of said arm members conforms to the contour of the lower back area of the person and it has a less pronounced curvature than the other arm member, and wherein said saddle means further includes an inwardly extending flange member that is positioned below said arm members so that it rests on the person's hip bone thereby keeping said holder in place and said saddle seat means is made out of an inflatable material;

B. belt means for removably securing said saddle seat means to said person's waist and said belt means being mounted to the ends of said arms; and C. strap means for partially supporting the weight of said saddle seat means and said strap means being of sufficiently large dimensions to extend over the neck and shoulder area opposite to the side of the person where said saddle seat means is mounted.

2. The holder set forth in claim 1 wherein said saddle seat means includes valve means for inflating said saddle seat means.

3. The holder set forth in claim 1 wherein said saddle seat means includes a plurality of reinforcement backing members longitudinally disposed along said leg and arm members thereby strengthening their rigidity.

4. The holder set forth in claim 2 wherein said valve means includes a one-way valve.

5. The holder set forth in claim 4 wherein said saddle seat means is made out of a flexible sheet of plastic.

6. The holder set forth in claim 4 wherein said saddle seat means is made out of a flexible sheet of rubber.

* * * * *